US007955115B2

(12) United States Patent
Morino et al.

(10) Patent No.: US 7,955,115 B2
(45) Date of Patent: Jun. 7, 2011

(54) EXTRACTION PREVENTING DEVICE FOR CONNECTOR

(75) Inventors: Satoru Morino, Yokkaichi (JP); Tatsuya Oka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/675,984

(22) PCT Filed: Feb. 14, 2008 (Under 37 CFR 1.47)

(86) PCT No.: PCT/JP2008/052407
§ 371 (c)(1), (2), (4) Date: Mar. 2, 2010

(87) PCT Pub. No.: WO2009/031326
PCT Pub. Date: Mar. 12, 2009

(65) Prior Publication Data

US 2011/0045684 A1 Feb. 24, 2011

(30) Foreign Application Priority Data

Sep. 3, 2007 (JP) ..... 2007-228177

(51) Int. Cl.
*H01R 13/627* (2006.01)

(52) U.S. Cl. ..... 439/357

(58) Field of Classification Search ..... 439/357, 439/358

See application file for complete search history.

(56) References Cited

U.S. PATENT DOCUMENTS

| | | | | | |
|---|---|---|---|---|---|
| 4,878,853 | A * | 11/1989 | Yamade et al. | ..... | 439/144 |
| 4,884,978 | A * | 12/1989 | Inaba et al. | ..... | 439/352 |
| 5,174,785 | A * | 12/1992 | Endo et al. | ..... | 439/489 |
| 5,246,380 | A * | 9/1993 | Kodama | ..... | 439/354 |
| 5,462,450 | A * | 10/1995 | Kodama | ..... | 439/489 |
| 5,464,351 | A * | 11/1995 | Oka | ..... | 439/372 |
| 5,980,297 | A * | 11/1999 | Sugie | ..... | 439/354 |
| 6,102,727 | A * | 8/2000 | Kawaguchi et al. | ..... | 439/372 |
| 6,325,656 | B1 * | 12/2001 | Fukuda et al. | ..... | 439/358 |
| 6,817,882 | B1 * | 11/2004 | Bauer et al. | ..... | 439/347 |
| 7,682,183 | B2 * | 3/2010 | Kanazawa | ..... | 439/357 |

FOREIGN PATENT DOCUMENTS

| | | |
|---|---|---|
| JP | 2-56371 | 4/1990 |
| JP | 9-245890 | 9/1997 |
| JP | 2006-228461 | 8/2006 |

* cited by examiner

*Primary Examiner* — T C Patel
*Assistant Examiner* — Vladimir Imas
(74) *Attorney, Agent, or Firm* — Gerald E. Hespos; Michael J. Porco

(57) ABSTRACT

A connector containing member on an electrical junction box is provided on an inner surface with a connector latching projection. A flexible piece being latched protrudes from a housing outer surface of a connector fitted in the connector containing member. A projection being latched that is provided on the piece being latched is locked on the connector latching projection. A cover attaching portion protrudes from a peripheral edge along one side of the connector containing member at the projecting side of the connector latching projection. A cover is secured to a cover attaching portion by screws after the connector is fitted in the connector containing member. The cover includes an interfering rib that protrudes outward from a connector receiving port, and a latching holder that is bent from a distal end of the interfering rib and is inserted into a clearance between the housing outer surface of the connector and the piece being latched.

3 Claims, 4 Drawing Sheets

EXTRACTION PREVENTING DEVICE FOR CONNECTOR

BACKGROUND OF THE INVENTION

1. Field of the Invention

This invention relates to an extraction preventing device for a connector and more particularly relates to an extraction preventing device that is provided in an electrical junction box and serves to restrain a connector fitted in a connector containing member on the electrical junction box from being readily extracted to prevent a car theft or the like.

2. Description of the Related Art

A connector is fitted in a connector containing member on an electrical junction box to be installed in a motor vehicle. A piece being latched is flexible from a front end to a rear end and protrudes from a housing outer surface of the connector. The piece being latched is provided with a projection being latched that is locked on the connector containing member. An example of such connector has been disclosed in JP 2006-228461 A.

As shown in FIGS. 4A and 4B, a connector 1 having an above structure is fitted in a connector containing member 2. The connector 1 is provided on a housing outer surface 1*a* with a piece being latched 1*b* that protrudes from the housing outer surface 1*a* and with a projection being latched 1*c* that protrudes from the piece being latched 1*b*. The connector containing member is provided on an inner surface with a connector latching projection 2*a* to be locked on the projection being latched 1*c*.

In order to fit the connector 1 into the connector containing member 2, firstly the connector 1 is inserted into the connector containing member 2 while the piece being latched 1*b* is deflected toward the housing outer surface 1*a*. Then, the projection being latched 1*c* slides over the connector latching projection 2*a*. When the piece being latched 1*b* returns to the original position on account of its elasticity, the projection being latched 1*c* is locked on the connector latching projection 2*a*. The piece being latched 1*b* of the connector 1 is provided on a rear end with a lock release operating portion 1*d* for releasing a locking state between the connector latching projection 2*a* and the projection being latched 1*c*. When a person pushes the lock release operating portion 1*d* by his or her finger to release the locking state, the connector can be readily removed from the connector containing member 2.

On the other hand, a serious problem of a car theft has been occurred recently in Japan and the foreign countries. To overcome the above problem, an anti-theft system such as an immobilizer has gone into actual use. For example, the immobilizer checks an ID code of an electronic communication chip (transponder) embedded in a key for a motor vehicle against an ID code registered before hand in an electronic control unit (ECU). If both codes do not coincide with each other, an engine in the motor vehicle is not started. This system is superior in point of an anti-theft effect.

However, if a unit related to an immobilizer including an electrical junction box is exchanged for an alternative unit at a time, an engine in a motor vehicle will be started without checking the ID codes, thereby enabling the motor vehicle to move as a theft car. Accordingly, it is a very important matter to make it difficult to extract a connector fitted in a connector containing member in a given electrical junction box, and to prevent the unit related to the immobilizer from being exchanged for an alternative unit.

However, since the locking state between the connector latching projection 2*a* and the projection being latched 1*c* can be readily released in the above fitting structure of the connector 1, there is a problem that the connector 1 is likely to be extracted from the connector containing member 2.

SUMMARY OF THE INVENTION

In view of the above problems, an object of the present invention is to provide a structure in which a connector fitted in a connector containing member in an electrical junction box cannot be readily extracted from the connector containing member.

In order to achieve the above object, the invention is directed to an extraction preventing device for a connector fitted in a connector containing member in an electrical junction box installed in a motor vehicle. The connector containing member is provided on a casing of the electrical junction box so that a connector receiving port is open outward. A connector latching projection is provided on an inner surface of the connector containing member. A piece being latched protrudes from a housing outer surface of the connector fitted in the connector containing member. The piece being latched has flexibility from a front end to a rear end in a connector inserting direction. A projection being latched that is provided on a rear part of the piece being latched is locked on an inserting side surface on the connector latching projection. A cover attaching portion protrudes from an outer surface of the connector containing member at the protruding side of the connector latching projection. A cover is secured to the cover attaching portion by screws after the connector is fitted in the connector containing member. The cover includes an interfering rib that protrudes outward from the connector receiving port in the connector containing member, and a latching holder that is bent from a distal end of the interfering rib and is inserted into a clearance between the housing outer surface and the piece being latched. A locking portion between the projection being latched of the piece being latched and the connector latching projection of the connector containing member is covered with the interfering rib and the latching holder of the cover so that a releasing jig cannot enter the locking portion from an outside.

As described above, the cover includes the interfering rib that protrudes outward from the connector receiving port in the connector containing member, and the latching holder that is bent from the distal end of the interfering rib and is inserted into the clearance between the housing outer surface and the piece being latched. After the connector is fitted into the connector containing member, the cover is attached to the connector containing member. That is, since the interfering rib protrudes outward from the connector receiving port, the locking state between the projection being latched and the connector latching projection cannot be released by pushing the lock release operating portion by a person's finger. In addition, since the locked portion is covered with the interfering rib and the latching holder bent from the distal end of the interfering rib, the releasing jig cannot be inserted into the locked portion from the outside of the connector containing member to release the locking state. Accordingly, the above structure makes it difficult to extract the connector from the connector containing member.

Further, since the latching holder is inserted into the clearance between the housing outer surface of the connector and the piece being latched, the piece being latched is not deflected by vibrations or the like in the direction for releasing the locking state, that is, a direction to the housing outer surface of the connector. Accordingly, it is possible to prevent the connector from being fallen down due to vibrations or the like and to enhance toughness against the vibrations or the like.

So long as the piece being latched is held so that the piece is not deflected in the latch releasing direction (direction to the housing outer surface of the connector), a shape of the piece being latched is not limited. For example, it is preferable that the piece being latched is substantially formed into the same tapered shape as that of the clearance between the housing outer surface of the connector and the piece being latched.

Also, as described above, the cover attaching portion protrudes from the peripheral edge along the one side of the connector containing member at the protruding side of the connector latching projection and the cover is secured to the cover attaching portion by screws. That is, in order to release the locking state between the connector latching projection and the piece being latched to extract the connector from the connector containing member, the screws must be removed from the cover attaching portion one after another to remove the cover from the cover attaching portion. This makes it difficult to extract the connector from the connector containing member. To increase the number of screws for securing the cover to the cover attaching portion or to use long screws can make it more difficult to extract the connector from the connector containing member.

In the case where the screws are low in number, long screws can make it difficult to extract the connector from the connector containing member. On the other hand, in the case where the screws are high in number, even short screws can make it difficult to extract the connector from the connector containing member. That is, the number of the covers, the number of the screws, and lengths of the screws can be combined suitably so as to enhance difficulty in extraction.

Further, it is preferable that a plurality of connector containing members are juxtaposed on the casing, a single cover is secured to the juxtaposed positions by the screws, and the cover is provided with the interfering ribs that interfere with the connectors fitted in the connector containing members and with the latching holders.

As described above, since the single cover comprises the interfering rib that interferes with the connectors fitted in the plural connector containing members and the latching holder, it is possible to reduce the number of parts and to enhance an attaching work of the cover.

On the other hand, if a unit related to the immobilizer including the electrical junction box is exchanged for an alternative unit at a time in a motor vehicle that installs the anti-theft system such as the immobilizer, the engine in the motor vehicle will be started without checking the ID codes, thereby enabling the motor vehicle to move as a theft car. Accordingly, it is a very important matter in a motor vehicle installing the anti-theft system to prevent the unit related to the immobilizer from being exchanged for an alternative unit by making it difficult to extract the connector fitted in the connector containing member in the given electrical junction box.

Accordingly, it is preferable that the connector enables a motor vehicle to move without checking the ID codes when the connector is extracted from the connector containing member, the connector cannot be extracted so as to prevent the motor vehicle from being stolen.

As described above, according to the present invention, the cover includes the interfering rib that protrudes outward from the connector receiving port in the connector containing member, and the latching holder that is bent from the distal end of the interfering rib and is inserted into the clearance between the housing outer surface and the piece being latched. After the connector is fitted into the connector containing member, the cover is attached to the connector containing member. Accordingly, the locking state between the projection being latched and the connector latching projection cannot be released by pushing the lock release operating portion by the person's finger. In addition, the releasing jig cannot be inserted into the locked portion from the outside of the connector containing member to release the locking state. Thus, the above structure makes it difficult to extract the connector from the connector containing member.

Also, since the latching holder is inserted into the clearance between the housing outer surface of the connector and the piece being latched, the piece being latched is not deflected by vibrations or the like in the direction for releasing the locking state, that is, a direction to the housing outer surface of the connector. Accordingly, it is possible to prevent the connector from being fallen down due to vibrations or the like and to enhance toughness against the vibrations or the like.

Also, as described above, since the cover attaching portion protrudes from the peripheral edge along the one side of the connector containing member at the protruding side of the connector latching projection and the cover is secured to the cover attaching portion by screws, in order to release the locking state between the connector latching projection and the piece being latched to extract the connector from the connector containing member, the screws must be removed from the cover attaching portion one after another to remove the cover from the cover attaching portion. This makes it difficult to extract the connector from the connector containing member.

Thus, it is possible to prevent a motor vehicle that installs an anti-theft system from being stolen by making it difficult to extract a connector from a connector containing member on a given electrical junction box.

DETAILED DESCRIPTION OF THE PREFERRED EMBODIMENTS

Figure 1A:
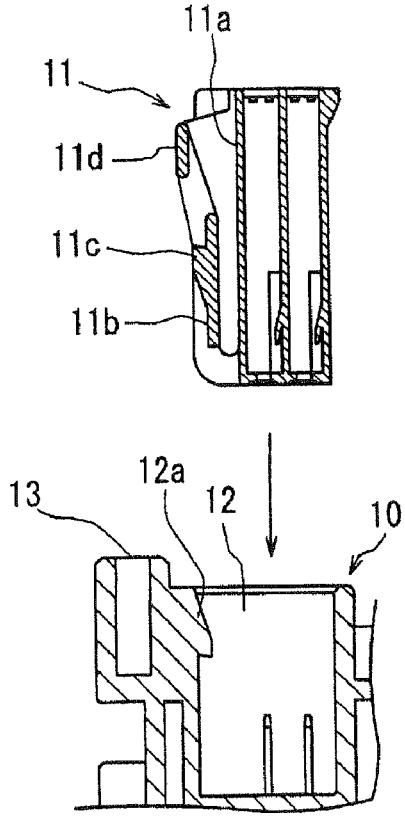
FIG. 1A is a sectional view of a main part of an extraction preventing device for a connector in accordance with the present invention, illustrating a process for fitting a connector into a connector containing member.

Referring now to the drawings, an embodiment of an extraction preventing device for a connector in accordance with the present invention will be described below.

Figure 1B:
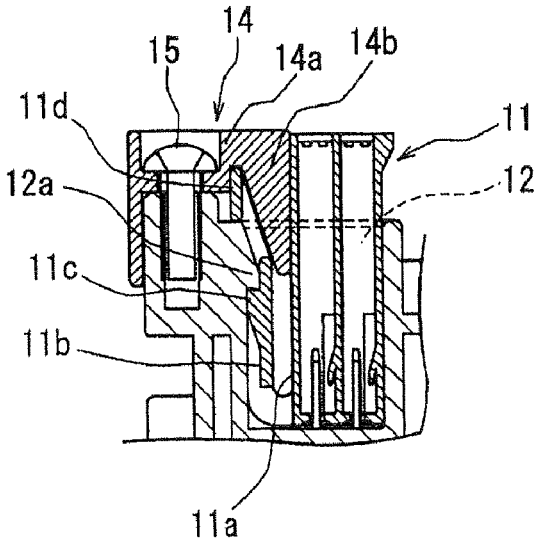
FIG. 1B is a sectional view of a main part of the extraction preventing device for a connector, illustrating the device in which a cover is attached to the connector containing member after the connector is fitted in the connector containing member.
Figure 2:
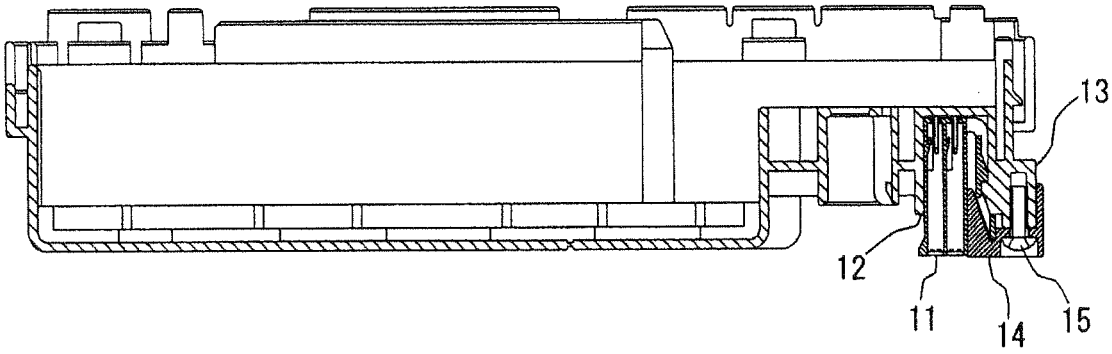
FIG. 2 is a longitudinal section view of an electrical junction box to which the cover is attached.
Figure 3:
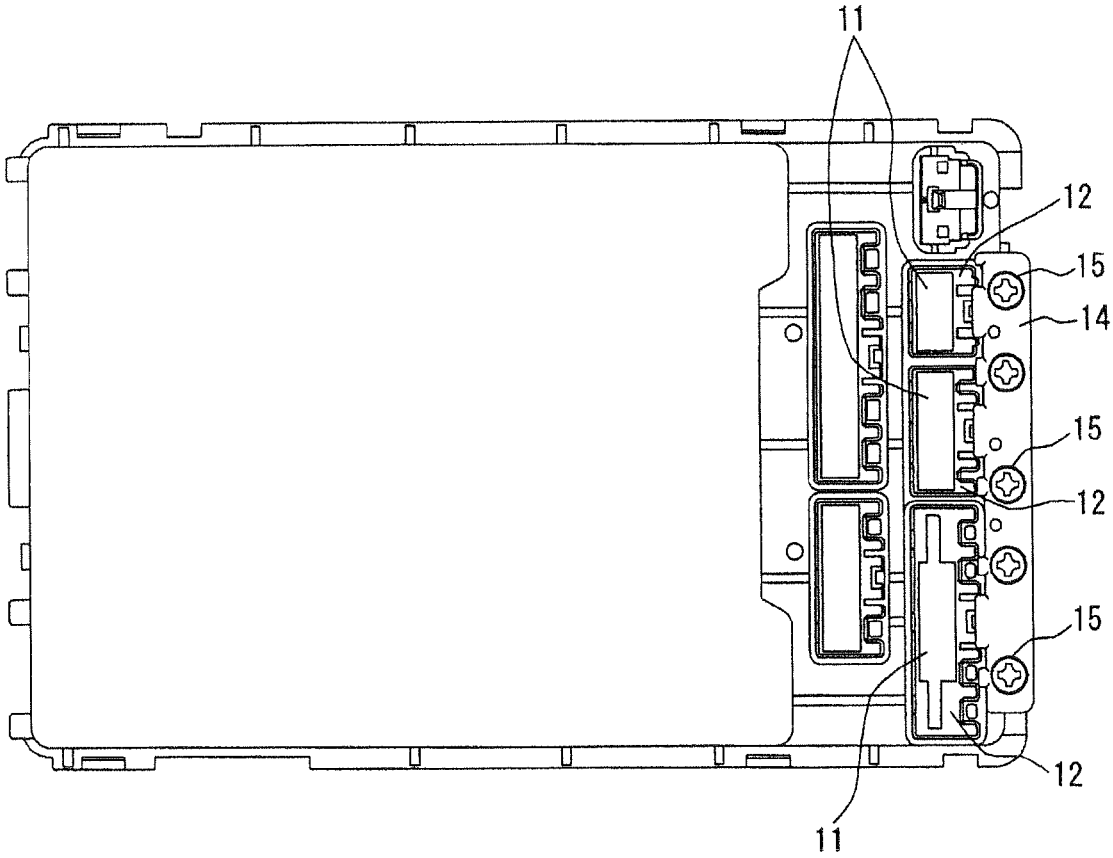
FIG. 3 is a bottom side view of a casing of the electrical junction box to which the cover is attached.
Figure 4A:
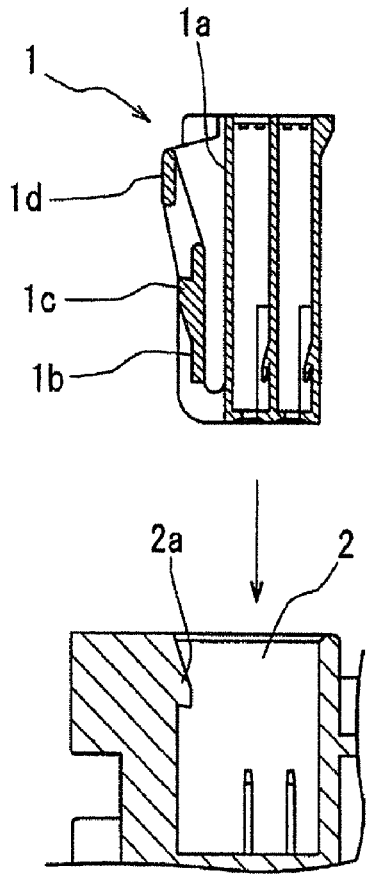
FIG. 4A PRIOR ART
FIG. 4A is a sectional view of a main part of a conventional locking structure for a connector, illustrating a process for fitting a connector into a connector containing member.
Figure 4B:
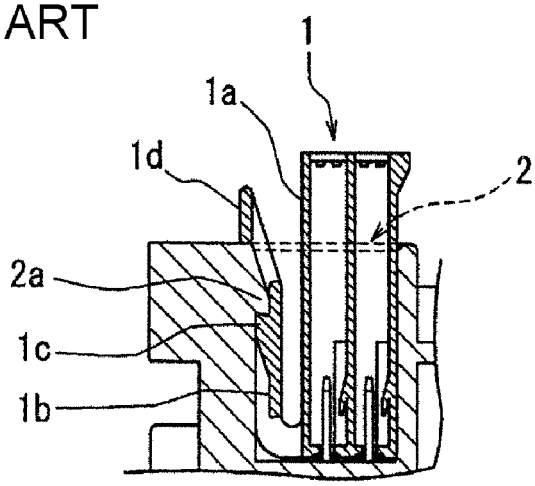
FIG. 4B PRIOR ART
FIG. 4B is a sectional view of a main part of the conventional locking structure for a connector, illustrating the structure in which the connector is fitted in the connector containing member.

FIG. 1A through FIG. 3 show an embodiment of an extraction preventing device for a connector in accordance with the present invention.

A casing 10 of an electrical junction box to be installed in a motor vehicle is provided with a plurality (three in the present embodiment) of connector containing members 12 for receiving connectors 11. A receiving port of each connector containing member 12 is directed outward.

A connector latching projection 12*a* protrudes from an inner surface of each connector containing member 12. A piece being latched 11*b* that is flexible from a front end to a rear end in a connector inserting direction (a direction shown by an arrow in FIG. 1A) protrudes an housing outer surface 11*a* of each connector 11 to be fitted in each connector containing member 12. Each piece being latched 11*b* is provided on a rear end with a projection being latched 11*c*. When each connector 11 is inserted into each connector containing member 12 and each projection being latched 11*c* is locked on an inserting side surface of each connector latching projection 12*a*, the connector 11 is completely fitted in the connector containing member 12.

In the present embodiment, each connector containing member 12 is disposed on a lower surface of the casing 10 of the electrical junction box. The electrical junction box is attached to an inner panel (not shown) of a driver's seat so that a lower surface of the casing 10 is disposed at a rear side. Although the connector containing members 12 are disposed on an upper surface of the casing 10, it is possible to more surely prevent the connector 11 from being subject to unauthorized access, if the connector containing members 12 are disposed on the lower surface of the casing 10.

Also, the electrical junction box is connected to a unit related to an immobilizer (in more detail, an immobilizer unit). When the connectors 11 are extracted from the connector containing members 12 of the casings 10 and the above unit including the electrical junction box is exchanged for an alternative unit at a time, a motor vehicle can move without checking ID codes.

Also, a plurality (five in the present embodiment) of cover attaching portions 13 protrude from a peripheral edge along one side of each connector containing member 12 at a protruding side of the connector latching projection 12*a* and are spaced from one another. After each connector 11 is fitted into each connector containing member 12, a single cover 14 is secured to the cover attaching portions 13 by a plurality (five in the present embodiment) of screws 15 (see FIG. 1B, FIG. 2, and FIG. 3). The single cover 14 is provided with an interfering rib 14*a* that protrudes outward from a connector receiving port of each connector containing member 12 and with a latching holder 14*b* that is bent from a distal end of the interfering rib 14*a* and is inserted into a clearance between the housing outer surface 11*a* of each connector 11 and each piece being latched 11*b*.

The latching holder 14*b* is formed into the substantially same tapered shape as that of the clearance between the housing outer surface 11*a* of each connector 11 and each piece being latched 11*b*. A locking portion between the connector latching projection 12*a* and the projection being latched 11*c* is covered with the interfering rib 14*a* and latching holder 14*b*. Accordingly, a releasing jig (not shown) cannot enter the locking portion from the outside.

According to the above construction, after the connectors 11 are fitted in the connector containing members 12, the cover 14 is attached to the one side of each connector containing member 12 at each projecting side of the connector latching projection 12*a*. The cover 14 comprises the interfering rib 14*a* that protrudes outward from the receiving port and the latching holder 14*b* to be inserted into the clearance between the housing outer surface 11*a* of the connector 11 and the piece being latched.

Accordingly, it is impossible for any person to release the locking state between the projection being latched 11*c* and the connector latching projection 12*a* by pushing a lock release operating portion 11*d* by the person's finger. In addition, it is impossible for any person to release the locking state by inserting the releasing jig into the locking portion from the outside. Accordingly, the above construction makes it difficult to extract the connector 11 from the connector containing member 12.

When the latching holder 14*b* is inserted into the clearance between the housing outer surface 11*a* of the connector 11 and the piece being latched 11*b*, the piece being latched 11*b* is not deflected by vibrations or the like in a direction for releasing the locking position, that is, in a direction toward the housing outer surface 11*a* of the connector 11. Consequently, it is possible to prevent the connector 11 from being fallen down by the lock releasing operation and to enhance toughness of the connector against the vibrations or the like.

Further, as described above, since the single cover 14 comprises the interfering rib 14*a* that interferes with the connectors 11 fitted in the plural connector containing members 12, and the latching holder 14*b*, it is possible to reduce the number of parts and to enhance efficiency in attaching work of the cover 14.

Also, as described above, since the cover attaching portion 13 is provided on the peripheral edge along the one side of the connector containing member 12 at the projecting side of the connector latching projection 12*a* and the cover 14 is secured to the cover attaching portion 13 by the plural screws 15, in order to release the locking state between the connector latching projection 12*a* and the piece being locked 11*c* and to extract the connector 11 from the connector containing member 12, firstly the plural screws 15 must be removed from the cover attaching portion 13 one after another, and secondly the cover 14 must be removed from the cover attaching portion 13. This will make it difficult to extract the connector 11 from the connector containing member 12.

In the case where the connectors that should be difficult in extraction are juxtaposed, it will be effective to reduce the number of parts by covering the all locking portions with a single cover. However, it will be possible to increase a working time necessary for extracting the connectors, if covers are mounted on the respective juxtaposed connector containing members.

Thus, it is possible to prevent a motor vehicle from being stolen by making it difficult to extract the connector 11 from the connector containing member 12 on the casing 10 of the electrical junction box, even if the motor vehicle installs an anti-theft system such as an immobilizer.

The invention claimed is:

1. An extraction preventing device for a connector fitted in a connector containing member in an electrical junction box installed in a motor vehicle;

wherein said connector containing member is provided on a casing of said electrical junction box so that a connector receiving port is open outward, a connector latching projection is provided on an inner surface of said connector containing member, a piece being latched protrudes from a housing outer surface of said connector fitted in said connector containing member, said piece being latched has flexibility from a front end to a rear end in a connector inserting direction, a projection being latched that is provided on a rear part of said piece being latched is locked on an inserting side surface on said connector latching projection;

wherein a cover attaching portion protrudes from an outer surface of said connector containing member at the protruding side of said connector latching projection, a cover is secured to said cover attaching portion by screws after said connector is fitted in said connector containing member;

wherein said cover includes an interfering rib that protrudes outward from said connector receiving port in said connector containing member, and a latching holder that is bent from a distal end of said interfering rib and is inserted into a clearance between said housing outer surface and said piece being latched; and wherein a locking portion between said projection being latched of said piece being latched and said connector latching projection on said connector containing member is covered with said interfering rib and said latching holder of said cover so that a releasing jig cannot enter said locking portion from an outside.

2. An extraction preventing device according to claim 1, wherein a plurality of connector containing members are juxtaposed on said casing, a single cover is secured to the juxtaposed positions by said screws, and said cover is provided with said interfering ribs that interfere with said connectors fitted in said connector containing members and with said latching holders.

3. An extraction preventing device according to claim 1, wherein said connector enables a motor vehicle to move without operating a key when said connector is extracted, said connector cannot be extracted so as to prevent said motor vehicle from being stolen.

* * * * *